US007870974B2

(12) United States Patent
Miller

(10) Patent No.: US 7,870,974 B2
(45) Date of Patent: Jan. 18, 2011

(54) ICE BUCKET HAVING A SLIDING DISPENSER

(75) Inventor: Lisa Miller, Norwalk, CT (US)

(73) Assignee: 32 and Dropping, LLC, Norwalk, CT (US)

( * ) Notice: Subject to any disclaimer, the term of this patent is extended or adjusted under 35 U.S.C. 154(b) by 481 days.

(21) Appl. No.: 12/098,674

(22) Filed: Apr. 7, 2008

(65) Prior Publication Data

US 2008/0256973 A1 Oct. 23, 2008

Related U.S. Application Data

(60) Provisional application No. 60/921,851, filed on Apr. 5, 2007.

(51) Int. Cl.
*B67D 1/16* (2006.01)

(52) U.S. Cl. ..... 222/108; 222/146.6; 222/181.1; 222/361; 222/444; 222/456; 222/547; 222/559; 62/459; 220/592.02

(58) Field of Classification Search ..... 222/108, 222/146.6, 440, 505, 181.1, 305, 185.1, 307, 222/351, 356, 357–359, 361, 561, 559, 564, 222/547, 450, 456, 451, 453, 444; 62/459, 62/344; 220/592.02, 592.01; 221/22
See application file for complete search history.

(56) References Cited

U.S. PATENT DOCUMENTS 2,857,083 A * 10/1958 Masterson ..... 222/361
2,983,408 A * 5/1961 Schwartz ..... 222/284
3,181,739 A 5/1965 Dye
4,084,725 A 4/1978 Buchser
4,109,835 A * 8/1978 Castro ..... 222/449
4,130,149 A * 12/1978 Hausam ..... 141/358
4,386,640 A 6/1983 Carr
4,555,049 A 11/1985 Mawby
4,673,111 A * 6/1987 Gold ..... 222/305
4,708,265 A * 11/1987 Bopst et al. ..... 222/43
4,718,578 A * 1/1988 Radek et al. ..... 222/108
4,964,546 A * 10/1990 Morrow et al. ..... 222/352
5,029,737 A 7/1991 Yamamoto
5,272,888 A 12/1993 Fisher
5,405,052 A 4/1995 Sawyer, III
5,683,011 A 11/1997 Miliani
5,758,803 A * 6/1998 Liao et al. ..... 222/440
6,148,636 A * 11/2000 Wade, Jr. ..... 62/604
6,257,016 B1 7/2001 Wade, Jr.
6,257,465 B1 7/2001 Treadwell
6,273,299 B1 8/2001 Hernowitz (Continued)

*Primary Examiner*—Frederick C. Nicolas
(74) *Attorney, Agent, or Firm*—Ohlandt, Greeley, Ruggiero & Perle, LLP

(57) ABSTRACT

An ice bucket is provided that includes an ice chamber, a dispensing tube, a base, and a sliding dispenser. The ice chamber has a chamber opening in a bottom wall. The dispensing tube is fixed to the bottom wall in communication with the chamber opening. The base has a base opening and a stabilizing bar. The sliding dispenser has a front lip, a depressed tray section, and a slider opening. The sliding dispenser is positioned through the base opening on the stabilizing bar so that an appendage of the dispensing tube is received in the depressed tray section. The sliding dispenser is movable between a retracted position and an extended position. The slider opening, in the retracted position, is blocked by the stabilizing portion. However, the slider opening, in the extended position, is unblocked by the stabilizing portion.

20 Claims, 4 Drawing Sheets

U.S. PATENT DOCUMENTS 6,488,182 B1 * 12/2002 Mohanraju et al. ..... 222/307
6,758,047 B1 7/2004 Giles
6,991,134 B2 * 1/2006 Bailey ..... 222/189.02

* cited by examiner

ICE BUCKET HAVING A SLIDING DISPENSER

CROSS REFERENCE TO RELATED APPLICATIONS

This application claims the benefit of U.S. Provisional Application Ser. No. 60/921,851, filed Apr. 5, 2007, the contents of which are incorporated by reference herein.

BACKGROUND OF THE INVENTION

1. Field of the Invention

The present disclosure is related to ice buckets. More particularly, the present disclosure is related to ice buckets having a sliding dispenser and, in some embodiments a water collection area.

2. Description of Related Art

There are many times when there is a need for a supply of ice at a location remote from a refrigerator or freezer. For example, during a party a host or hostess may set up a drink station, where cups, drinks, coasters and other items are located. Here, it is common to store ice in a bucket or bowel.

For reasons of hygiene, it is desired that a person or persons not use their hands to retrieve ice from the bucket. Thus, it is common place for the host or hostess to provide an ice retrieval device, such as a spoon or a pair of tongs or an unused cup, for use in retrieving ice from the bucket.

Unfortunately, ice retrieval devices can also present less than optimal hygienic conditions. More particularly, the use of such ice retrieval devices still requires the user to place their hands and/or the ice retrieval devices inside the bucket, potentially transferring germs into the ice and/or bucket.

Furthermore, ice buckets intended for use with such ice retrieval devices must have sufficiently large internal dimensions so as to allow the ice retrieval device to enter the storage area and remove the ice. Accordingly, prior art ice buckets require a particular large internal dimension, which limits the design choices available for such buckets.

Accordingly, it has been determined by the present disclosure that there is a continuing need for ice buckets that that overcome, alleviate, and/or mitigate one or more of the aforementioned and other deleterious effects of the prior art.

BRIEF SUMMARY OF THE INVENTION

An ice bucket is provided that includes an ice chamber, a dispensing tube, a base, and a sliding dispenser. The ice chamber has a chamber opening in a bottom wall. The dispensing tube is fixed to the bottom wall in communication with the chamber opening. The base has a base opening and a stabilizing bar. The sliding dispenser has a front lip, a depressed tray section, and a slider opening. The sliding dispenser is positioned through the base opening on the stabilizing bar so that an appendage of the dispensing tube is received in the depressed tray section. The sliding dispenser is movable between a retracted position and an extended position. The slider opening, in the retracted position, is blocked by the stabilizing portion. However, the slider opening, in the extended position, is unblocked by the stabilizing portion.

In some embodiments, ice in the ice chamber advances down the dispensing tube, under the force of gravity, and when the sliding dispenser is in the retracted position, rests in the dispensing tube, in the depressed tray section and, via the slider opening, on the stabilizing bar.

The ice bucket can dispense ice, under the weight of gravity, as long as the sliding dispenser is in the extended position with the slider opening unblocked by the stabilizing portion.

The movement of the sliding dispenser from the extended position to the retracted position results in ice within the depressed tray section and on the stabilizing bar being pushed by the appendage towards the slider opening.

The movement of the sliding dispenser from the extended position to the retracted position results in any ice not pushed through the slider opening by the appendage remaining in the dispensing tube, the depressed tray section, and, via the slider opening, on the stabilizing bar.

The sliding dispenser is prevented from being removed from the ice bucket due to an interference of the appendage with a rear wall of the sliding dispenser.

An ice bucket is also provided that includes an ice chamber, a base, and a sliding dispenser. The ice chamber has a chamber opening and a dispensing tube in fluid communication with the chamber opening. The dispensing tube is positioned proximate a front edge of the ice chamber. The base has a base opening and a stabilizing bar. The sliding dispenser has a front lip, a depressed tray section, and a slider opening. The sliding dispenser is positioned through the base opening on the stabilizing bar so that an appendage at a rear section of the dispensing tube is received in the depressed tray section. The sliding dispenser is movable between a retracted position having the slider opening blocked by the stabilizing portion and the base opening blocked by the front lip and an extended position having the slider opening unblocked by the stabilizing portion and the base opening unblocked by the front lip. Ice in the ice chamber advances down the dispensing tube, under the force of gravity, and rests in the dispensing tube, in the depressed tray section and, via the slider opening, on the stabilizing bar when the sliding dispenser is in the retracted position.

In some embodiments, movement of the sliding dispenser from the extended position to the retracted position results in ice within the depressed tray section and on the stabilizing bar being pushed by the appendage towards the slider opening.

The above-described and other features and advantages of the present disclosure will be appreciated and understood by those skilled in the art from the following detailed description, drawings, and appended claims.

DETAILED DESCRIPTION OF THE INVENTION

Figure 1:
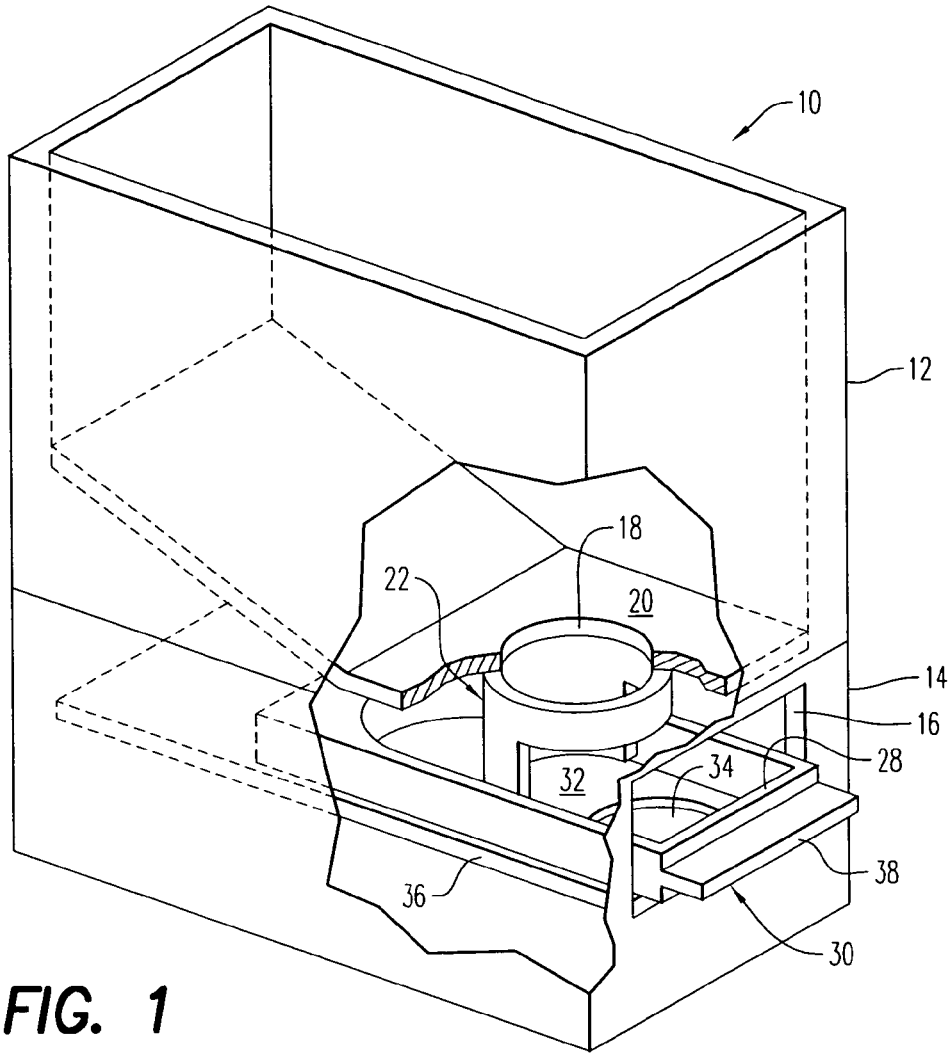
FIG. 1 is cross sectional view of an exemplary embodiment of an ice bucket according to the present disclosure.
Figure 2:
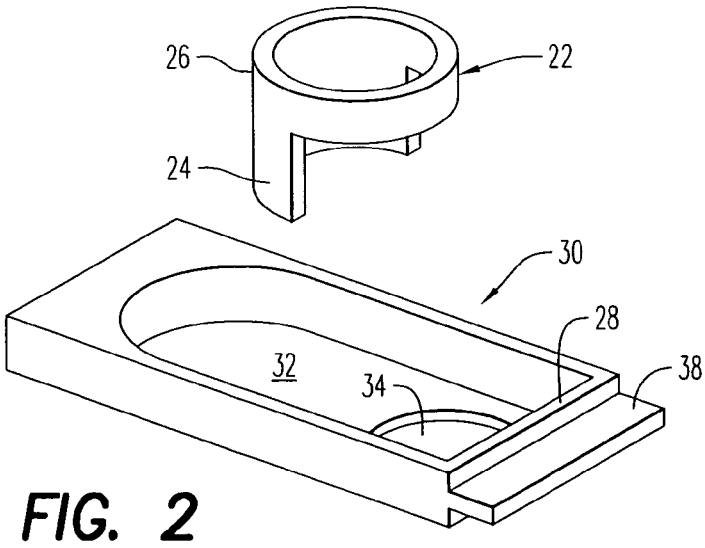
FIG. 2 is a sectional view of an exemplary embodiment of a slider of the ice bucket of FIG. 1.

Referring to the drawings and in particular to FIGS. 1 and 2, an ice bucket according to the present disclosure is shown and generally represented by reference numeral 10.

Advantageously, the bucket 10 of the present disclosure allows the user to remove ice without the use of an ice removal device (e.g., spoons, tongs, cups). As such, the shape and size of the ice chamber is not required to accommodate the ice removing device and, thus, can be made taller and with a smaller cross section than was previously possible. Furthermore, bucket 10 of the present disclosure allows the user to remove ice without the hygiene issues associated with such ice removal devices.

Bucket 10 includes, in part, a chamber 12 and a base 14 having a base opening 16. In some embodiments, chamber 12 can be an insulated chamber. Chamber 12 and base 14 can, in some embodiments, be attached to one another. In other embodiments, chamber 12 and base 14 can be integrally formed with one another, while in still other embodiments the base can simply support the chamber.

Chamber 12 has a chamber opening 18 in a bottom wall 20 thereof. Chamber opening 18 lines up with a dispensing tube 22, such that chamber 12 and tube 22 are in fluid communication with one another via opening 18. Dispensing tube 22 includes an appendage 24 on a rear section 26. Dispensing tube 22 is fixed to the bottom wall 20 of ice chamber 12 in a stationary position.

Bucket 10 further includes a sliding dispenser 30 (herein after "slider"). Slider 30 fits through base opening 16 so that tube 22 rests over the slider.

As best seen in FIG. 2, slider 30 includes a front lip 28, a depressed tray section 32, and a slider opening 34. Slider 30 rests on a stabilizing bar 36 that extends from the front to the rear of base 14. Slider 30 also includes a handle section 38 that extends from base opening 16 in order to the slider in and out of base 14.

When ice is put into chamber 12, the ice advances down tube 22 and rests in tray section 32 of slider 30 and, via slider opening 34, on stabilizing bar 36. When slider 30 is moved, the motion of the slider, in combination with the action of the ice pushing up against appendage 24, propels the ice into slider opening 34 and out of bucket 10.

Referring now to FIGS. 3 through 7, an alternate embodiment of an exemplary embodiment of a bucket according to the present disclosure is shown and is generally referred to by reference numeral 110. Component parts of bucket 110 performing similar and/or analogous functions to those of bucket 10 are labeled in multiples of one hundred.

Bucket 110 includes a chamber 112, a base 114, a lid 140, and a water drainage pan 142. In some embodiments, one or more components of bucket 10 including chamber 112, base 114, lid 140, pan 142, and any combinations thereof can be insulated members. In other embodiments, the pan 142 can include one or more non-skid areas (not shown) defined thereon.

Base 114 has a base opening 116 and chamber 112 has a chamber opening 118 in a wall 120 thereof. Chamber opening 118 lines up with a dispensing tube 122, such that chamber 112 and tube 122 are in fluid communication with one another via opening 118. Dispensing tube 122 includes an appendage 124 on a rear section of the tube.

Bucket 110 further includes a sliding dispenser 130 (herein after "slider"). Slider 130 fits through base opening 116 so that tube 122 rests over the slider.

Figure 6:
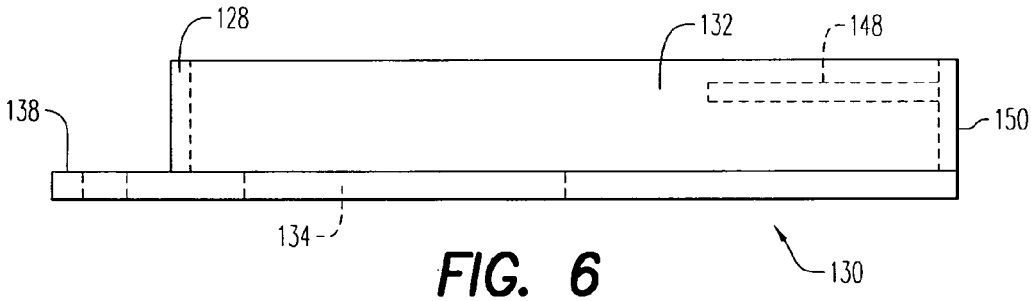
FIG. 6 is a side view of the slider of FIG. 3.
Figure 7:
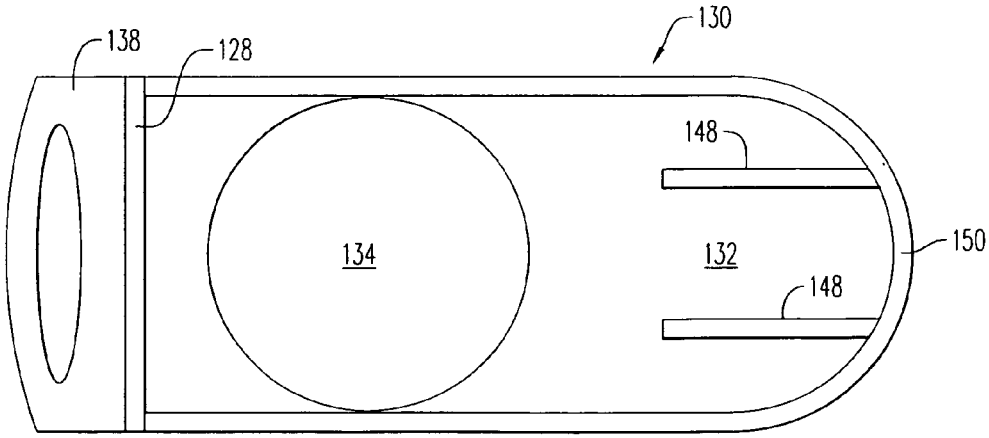
FIG. 7 is a top view of the slider of FIG. 3.

As best seen in FIGS. 6 and 7, slider 130 includes a depressed tray section 132, a slider opening 134, a front lip 128, and a rear wall 150.

Slider 130 slidably rests on a stabilizing portion 136 of base 114. In some embodiments, stabilizing portion 136 extends from the front to the rear of base 114. Slider 130 slidably rests on stabilizing portion 136 so that tube 122 rests over the slider and appendage 124 is received in depressed tray section 132. In this manner, slider 130 is prevented from being removed from bucket 110 due to the interference of appendage with rear wall 150.

In some embodiments, slider 130 can include a handle section 138 that extends from base opening 116 in order to the slider in and out of base 114.

In other embodiments, bucket 110 can include a carrying handle (not shown) attached to chamber 112, base 114, pan 142, or any combinations thereof. The handle can allow the user to carry bucket 110 to any desired location.

Chamber 112 can include one or more baffles 144 disposed therein. Baffles 144 are configured to guide ice within the chamber 112 towards chamber opening 118. In this manner, baffles 144 ensure that the ice flows into tube 122. Baffles 144 are shown as generally linear members. Of course, it is contemplated by the present disclosure for baffles 144 to have any shape configured to guide ice within the chamber 112 towards chamber opening 118 such as, but not limited to, a linear shape, a curved shape, and any combinations thereof. Furthermore, it is contemplated by the present disclosure for baffles 144 to be integrally formed in chamber 112 or to be positioned in the chamber.

Water drainage pan 142 is removably secured to base 114 and forms a water tight storage area for the collection of water resulting from the melting of any ice in bucket 10. More particularly, melted ice within chamber 112 can flow through at least openings 118 and 134 into water drainage pan 142. In some embodiments, bucket 110 can include one or more drainage openings (not shown) in one or more portions of the bucket such as, but not limited to, wall 120, baffles 144, stabilizing portion 136, slider 130, and any combinations thereof. In order to remove the collected water from water drainage pan 142, the user can separate the water drainage pan from base 114.

Figure 4:
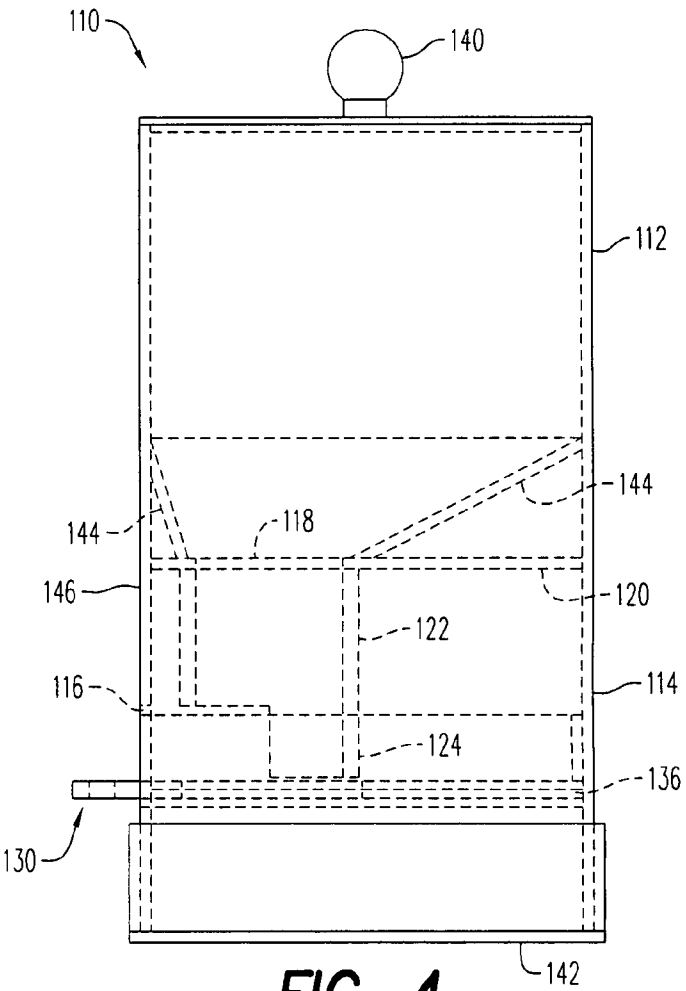
FIG. 4 is a side view of the ice bucket of FIG. 3 showing the slider in a retracted position.
Figure 3:
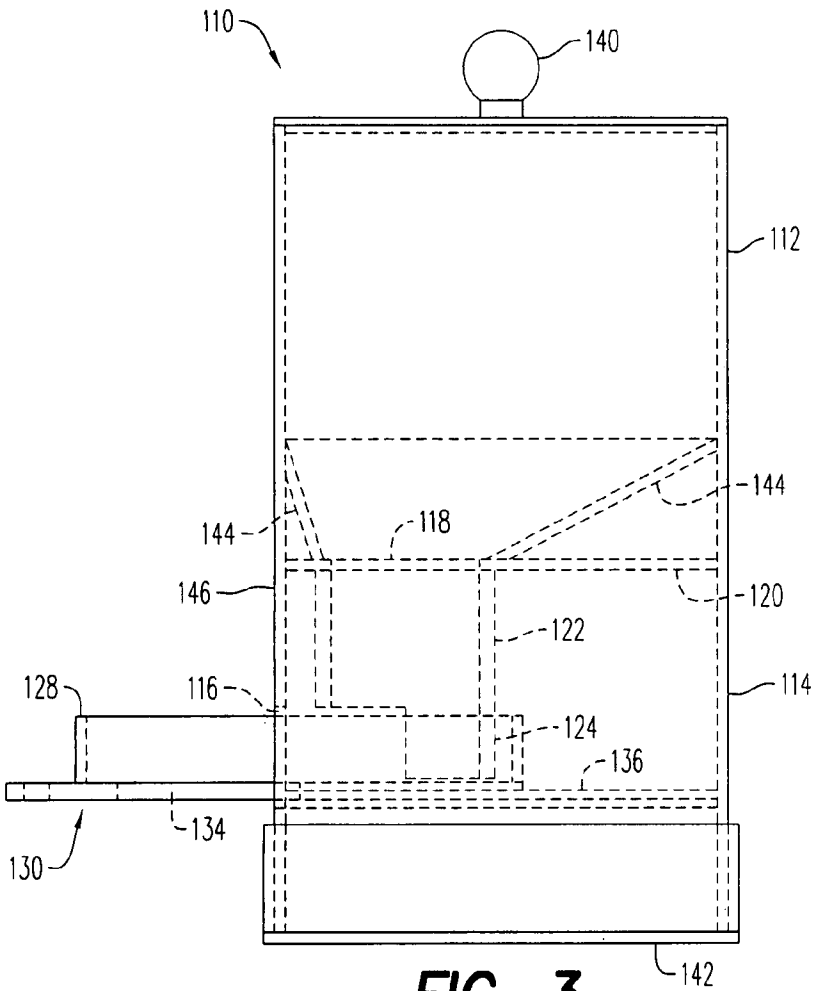
FIG. 3 is a side view of a second exemplary embodiment of an ice bucket according to the present disclosure showing the slider in an extended position.

In use, a user can remove lid 140 from chamber 112 and can move slider 130 to the retracted position shown in FIG. 4. Next, the user can fill chamber 112 with ice with baffles 144 ensuring that the ice advances through opening 118 into tube 122 until chamber 112 is full. The user can then replace lid 140 on the chamber 122 until ice is desired.

The ice in chamber 112 advances down tube 122 and rests in depressed tray section 132 of slider 130 and, via slider opening 134, on stabilizing portion 136. When ice is desired, the user can move slider 130 outward to the extended position shown in FIGS. 3 and 5. The motion of slider 130 to the extended position, in combination with the action of the ice pushing up against appendage 124, propels the ice into slider opening 134 and out of bucket 10 under the force of gravity.

Accordingly, bucket 110 includes a stationary dispensing tube 122 that is in fluid communication with a moving slider. The stationary tube 122 is positioned proximate a front edge 146 of chamber 112 in a stationary position. The ice in chamber 112 falls through stationary tube 122 into slider 130 when the slider is in the retracted position (FIG. 4). Movement of slider 130 to the extended position (FIGS. 3 and 5) results in the ice within depressed tray section 132 being pushed by appendage 124 of the tube 122 towards and through slider opening 134.

Figure 5:
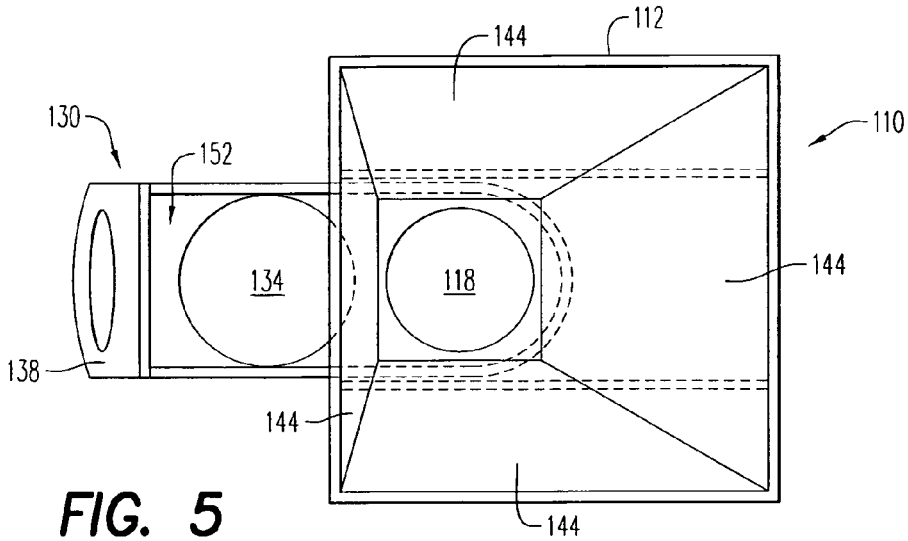
FIG. 5 is a top view of the ice bucket of FIG. 3, having the lid removed.

As best seen in FIG. 5, bucket 110 is shown having a generally square cross section. However, it is contemplated by the present disclosure for bucket 110 to have any desired cross section such as, but not limited to, circular, oval, polygonal, and any combinations thereof.

Appendage 124 pushes the ice from depressed tray section 132 towards opening 134 as the slider 130 is moved to the retracted position (FIG. 4). Depressed tray section 132 of slider 130 provides bucket 110 with a smooth or substantially jam free dispensing action. For example and without wishing to be bound by any particular theory, if slider 130 lacked depressed tray section 132 and was simply a flat surface with opening 134, as the slider was pushed in (i.e., moved to the retracted position), the slider would jam.

Advantageously, slider 130 having depressed tray section 132 will dispense ice, under the weight of gravity, as long as the slider is in the extended position with opening 134 unblocked by stabilizing portion 136.

As slider 130 is moved from the extended position (FIGS. 3 and 5) to the retracted position (FIG. 4), opening 134 is blocked by stabilizing portion 136 and opening 116 is covered by lip 128. As slider 130 is moved to the retracted position, any ice not pushed through opening 134 as a result of opening 134 being blocked by stabilizing portion 136 remains in depressed tray section 132 and tube 122 to be used the next time slider 130 is moved to the extended position.

Furthermore, slider 130 can include a region 152 between opening 134 and front lip 128 to accommodate this ice remaining in tray section 132. More particularly, region 152 can be sized and configured to accommodate ice pushed by appendage 124 forward of opening 134 when that ice can not fall through the opening 134 as a result of being blocked by stabilizing portion 136. As such, region 152 can also assist in ensuring slider 130 can be moved to the retracted position without jamming.

In an alternate embodiment, and with reference to FIGS. 5 and 6, slider 130 can include one or more blocking devices 148 extending from rear wall 150 into tray section 132. Blocking devices 148 are slidably received through a corresponding number of openings (not shown) of tube 122 when slider 130 is in the extended position of FIG. 3. In this position, blocking devices 148 can mitigate the weight of ice within chamber 112 from forcing additional ice through tube 122, through tray section 132, and opening 134 so that ice is generally only dispensed when the slider is moved from the extended position to the retracted position. Further, blocking devices 148 are retracted from the tube 122 when slider 130 is in the retracted position. In this position, blocking devices 148 allow ice within chamber 112 to freely drop, under the force of gravity, through tube 122 and into through tray section 132.

Figure 8:
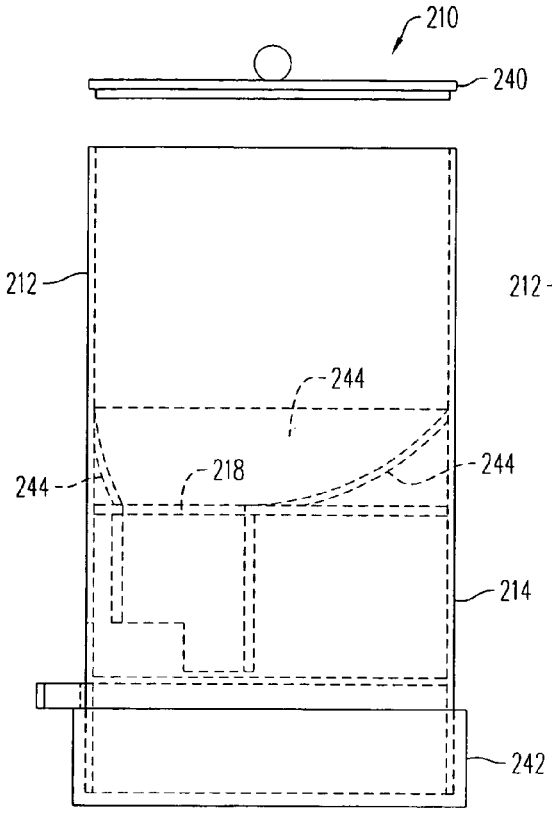
FIG. 8 is a side view of a third exemplary embodiment of an ice bucket according to the present disclosure, having the slider and the lid removed.
Figure 9:
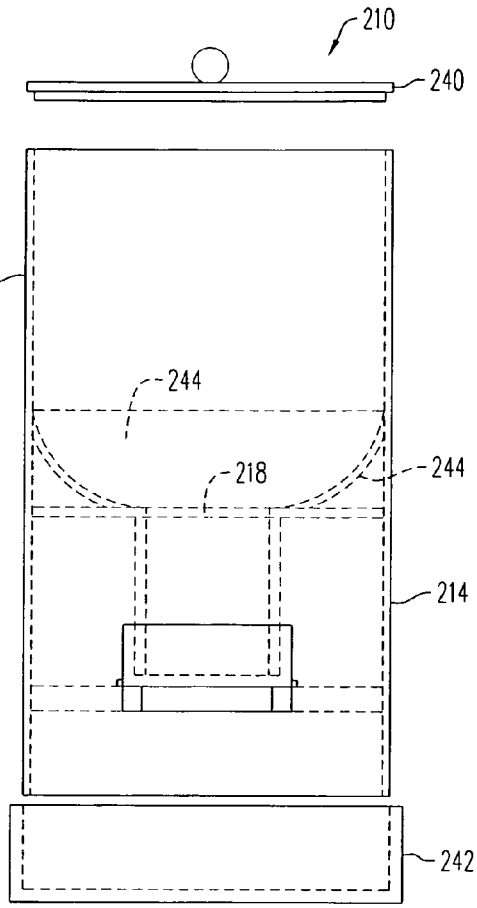
FIG. 9 is a front view of the ice bucket of FIG. 8 having the drainage device removed.
Figure 10:
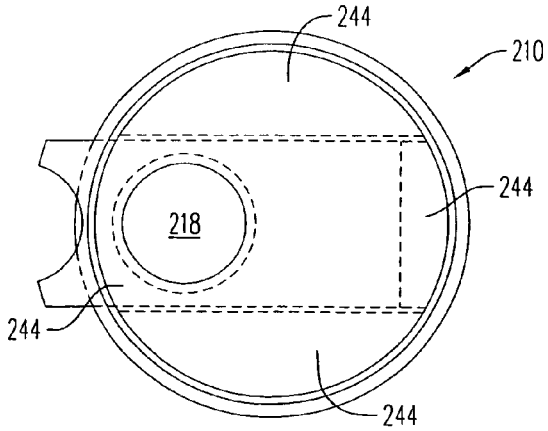
FIG. 10 is a top view of the ice bucket of FIG. 8.

Referring now to FIGS. 8 through 10, another alternate embodiment of an exemplary embodiment of a bucket according to the present disclosure is shown and is generally referred to by reference numeral 210. Again, component parts of bucket 210 performing similar and/or analogous functions to those of bucket 10 and/or bucket 110 are labeled in multiples of one hundred.

Bucket 210 includes a chamber 212, a base 214, a lid 240, and a water drainage pan 242. Chamber 212 includes one or more baffles 244 disposed therein. Baffles 244 are configured to guide ice within the chamber 212 towards a chamber opening 218. In this embodiment, baffles 244 are curved members. In addition and as best seen in FIG. 10, bucket 210 is shown having a generally circular cross section.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

PARTS LIST

| | |
|---|---|
| ice bucket | 10 |
| chamber | 12 |
| base | 14 |
| base opening | 16 |
| chamber opening | 18 |
| bottom wall | 20 |
| dispensing tube | 22 |
| appendage | 24 |
| rear section | 26 |
| front lip | 28 |
| slider | 30 |
| depressed tray section | 32 |
| slider opening | 34 |
| stabilizing bar | 36 |
| handle section | 38 |
| bucket | 110 |
| chamber | 112 |
| base | 114 |
| lid | 140 |
| water drainage pan | 142 |
| base opening | 116 |
| chamber opening | 118 |
| wall | 120 |
| dispensing tube | 122 |
| appendage | 124 |
| front up | 128 |
| sliding dispenser | 130 |
| tray section | 132 |
| slider opening | 134 |
| stabilizing portion | 136 |
| handle section | 138 |
| baffles | 144 |
| front edge | 146 |
| blocking devices | 148 |
| wall | 150 |
| region | 152 |
| bucket | 210 |
| chamber | 212 |
| base | 214 |
| lid | 240 |
| water drainage pan | 242 |
| baffles | 244 |

What is claimed is:

1. An ice bucket, comprising:

an ice chamber having a chamber opening in a bottom wall thereof;

a dispensing tube fixed to said bottom wall in fluid communication with said chamber opening, said dispensing tube having an appendage on a rear section;

a base having a base opening and a stabilizing bar, said base supporting said ice chamber; and a sliding dispenser having a front lip, a depressed tray section, and a slider opening, said sliding dispenser being slidably positioned through said base opening on said stabilizing bar so that said appendage is received in said depressed tray section, said sliding dispenser being movable between a retracted position and an extended position, wherein said slider opening, in said retracted position, is blocked by said stabilizing portion and said base opening is blocked by said front lip, and wherein said slider opening, in said extended position, is unblocked by said stabilizing portion and said base opening is unblocked by said front lip.

2. The ice bucket of claim 1, wherein, when said sliding dispenser is in said retracted position, ice in said ice chamber advances down said dispensing tube, under the force of gravity, and rests in said dispensing tube, in said depressed tray section and, via said slider opening, on said stabilizing bar.

3. The ice bucket of claim 2, wherein said sliding dispenser dispenses ice, under the weight of gravity, as long as said sliding dispenser is in the extended position with said slider opening unblocked by said stabilizing portion.

4. The ice bucket of claim 2, wherein movement of said sliding dispenser from said extended position to said retracted position, results in ice within said depressed tray section and on said stabilizing bar being pushed by said appendage towards said slider opening.

5. The ice bucket of claim 4, wherein during movement of said sliding dispenser from said extended position to said retracted position any ice not pushed through said slider opening as a result of said slider opening being blocked by said stabilizing portion remaining in said dispensing tube, in said depressed tray section, and, via said slider opening, on said stabilizing bar.

6. The ice bucket of claim 5, where said sliding dispenser further comprises a region between said slider opening and said front lip, said region being configured to accommodate ice pushed by said appendage forward of said slider opening when that ice can not fall through said slider opening as a result of said slider opening being blocked by said stabilizing portion.

7. The ice bucket of claim 1, wherein said sliding dispenser is prevented from being removed from the ice bucket due to an interference of said appendage with a rear wall of said sliding dispenser.

8. The ice bucket of claim 1, wherein said sliding dispenser further comprises a handle section.

9. The ice bucket of claim 1, further comprising a lid removably disposed on said ice chamber.

10. The ice bucket of claim 1, further comprising a water drainage pan removably disposed under said base.

11. The ice bucket of claim 1, further comprising an insulated component selected from the group consisting of said ice chamber, said base, a lid, a water drainage pan and any combinations thereof.

12. The ice bucket of claim 1, wherein said stabilizing portion extends from a front of said base to a rear of said base.

13. The ice bucket of claim 1, wherein said dispensing tube is positioned proximate a front edge of said ice chamber.

14. The ice bucket of claim 13, further comprising one or more baffles disposed in said ice chamber, said one or more baffles being configured to guide ice within said ice chamber towards said chamber opening.

15. The ice bucket of claim 14, wherein said one or more baffles have a shape selected from the group consisting of a linear shape, a curved shape, and any combinations thereof.

16. The ice bucket of claim 1, wherein the ice bucket has a cross section selected from the group consisting of square, circular, oval, polygonal, and any combinations thereof.

17. The ice bucket of claim 1, wherein said ice chamber and said base are attached to one another or are integrally formed with one another.

18. The ice bucket of claim 1, further comprising one or more blocking devices extending from said rear wall into said depressed tray section, said one or more blocking devices being slidably received through a corresponding number of openings in said dispensing tube when said sliding dispenser is in said extended position and being retracted from said dispensing tube when said sliding dispenser is in said retracted position.

19. An ice bucket, comprising:

an ice chamber having a chamber opening and a dispensing tube in fluid communication with said chamber opening, said dispensing tube being positioned proximate a front edge of said ice chamber a base having a base opening and a stabilizing bar, said base supporting said ice chamber; and a sliding dispenser having a front lip, a depressed tray section, and a slider opening, said sliding dispenser being slidably positioned through said base opening on said stabilizing bar so that an appendage at a rear section of said dispensing tube is received in said depressed tray section, wherein said sliding dispenser is movable between a retracted position having said slider opening blocked by said stabilizing portion and said base opening blocked by said front lip and an extended position having said slider opening unblocked by said stabilizing portion and said base opening unblocked by said front lip, and wherein ice in said ice chamber advances down said dispensing tube, under the force of gravity, and rests in said dispensing tube, in said depressed tray section and, via said slider opening, on said stabilizing bar when said sliding dispenser is in said retracted position.

20. The ice bucket of claim 19, wherein movement of said sliding dispenser from said extended position to said retracted position, results in ice within said depressed tray section and on said stabilizing bar being pushed by said appendage towards said slider opening.

* * * * *